United States Patent [19]

Daume

[11] 4,021,514

[45] May 3, 1977

[54] METHOD FOR THE PRODUCTION OF AN INHIBITOR COATING FOR A SOLID ROCKET PROPELLENT CHARGE

[75] Inventor: Eduard Daume, Richterswil, Switzerland

[73] Assignee: Werkzeugmaschinenfabrik Oerlikon-Buhrle AG, Zurich, Switzerland

[22] Filed: Mar. 29, 1976

[21] Appl. No.: 671,414

Related U.S. Application Data

[62] Division of Ser. No. 587,322, June 16, 1975.

[30] Foreign Application Priority Data

June 21, 1974 Switzerland ..... 8518/74

[52] U.S. Cl. ..... 264/3 E; 264/3 R; 149/19.4; 149/2

[51] Int. Cl.[2] ..... C06B 21/00

[58] Field of Search ..... 149/2, 19.4; 264/3 R, 264/3 D, 3 E; 102/103

[56] References Cited

UNITED STATES PATENTS

| | | | |
|---|---|---|---|
| 3,144,830 | 8/1964 | DeFries et al. | 102/103 |
| 3,447,980 | 6/1969 | Voigt | 149/19.4 |
| 3,529,042 | 9/1970 | Lippert | 149/19.4 X |
| 3,554,820 | 1/1971 | Evans | 149/19.4 |
| 3,682,727 | 8/1972 | Heinzelmann et al. | 149/19.4 X |
| 3,714,047 | 1/1973 | Marion et al. | 102/103 X |
| 3,716,604 | 2/1973 | Dehm | 102/103 X |
| 3,734,982 | 5/1973 | Sampson | 264/3 R |
| 3,813,308 | 5/1974 | Skidmore | 149/109 |
| 3,855,176 | 12/1974 | Skidmore | 102/103 X |

*Primary Examiner*—Peter A. Nelson
*Attorney, Agent, or Firm*—Werner W. Kleeman

[57] ABSTRACT

A method of producing an inhibitor coating for a solid propellent charge for protecting against undesired burning-off, the inhibitor coating containing an insulating layer composed of a binder and a filler, a protective- and adhesion layer located between the insulating layer and the propellent charge. The binder consists of a castable mass which has poor smoke developing properties, the filler of a fine granular cooling agent possessing good packability, the protective- and adhesion layer of a completely set or cured polyisocyanate forming a barrier against plasticizer migration. For the insulating layer there is initially admixed a pre-adduct with the cooling agent, and subsequently adding an aromatic diamine, an aliphatic plasticizer or an aliphatic polyol.

10 Claims, No Drawings

METHOD FOR THE PRODUCTION OF AN INHIBITOR COATING FOR A SOLID ROCKET PROPELLENT CHARGE

CROSS REFERENCE TO RELATED CASE

This is a divisional application of my commonly assigned, copending United States application Ser. No. 587,322, filed June 16, 1975.

BACKGROUND OF THE INVENTION

The present invention relates to a new and improved inhibitor coating or the like for solid propellent charges for protecting against undesired burning-off, the inhibitor coating comprising an insulating layer containing a binder and a filler, and a protective- and adhesion layer which is located between the insulating layer and the propellent charge.

Inhibitor coatings of this type are known to the art by means of which there is covered a portion of the surface of the propellent charge in order to protect such surfaces against undesired burn-off. This measure is necessary when the rocket propellent charges are freely exposed within the rocket combustion chamber, especially when the propellent charge is constructed as an internal burner or an end burner. In both cases the effective burning surface of the propellent charge is determined by the reliable insulation of the remaining surfaces of the propellent charge. An undesired burn-off or burning-off at such insulated surfaces owing to detachment or failure of the insulating layer leads to ballistic malfunctions or tearing-down of the rocket and must be prevented.

Requirements Which Are Placed Upon The Coating

The following requirements are placed upon the quality of the inhibitor coating or covering:

a. The coating must be capable of withstanding temperature fluctuations in a range between −40° C to +60° C, i.e. it is either elastic or it possesses the same coefficient of expansion as the propellent charge.

b. The coating must be capable of withstanding the mechanical and thermal loads during the burn-off, for instance, the acceleration forces during the flight of the rocket.

c. The coating must be capable of being removed in as gaseous state as possible during the burning-off, since larger proportions of carbon black particles or other solid particles lead to the pronounced formation of smoke, something which must be absolutely avoided in the case of wire-guided rockets.

d. The coating must not decompose or disintegrate into larger pieces or parts, since otherwise such parts can clog the nozzles.

Composition Of The Coating

These prior art inhibitor coatings can contain:

a. an organic binder formed of plasticized or nonplasticized plastomeric or elastomeric polymers, b. inorganic or organic fillers, c. fabrics formed of polymeric organic or inorganic substances, for instance formed of polyesters or glass which can be wound about the propellent charge.

Manufacture And Application Of The Coating

These inhibitor coatings are applied by immersing the propellent charge in an insulating bath, by coating, by pressing-on, casting or by adhesively bonding skins or hides. The momentarily employed manufacturing technique is dictated by the composition of the binder.

The Drawbacks And Difficulties Of The State-Of-The Art Coatings a. Coatings containing plastomeric binders, e.g. ether and ester derivatives of cellulose can only be applied in a dissolved state as a lacquer by immersion, coating or spraying.

b. There can be only applied relatively thin layers, so that there are necessary the application of a number of layers and hence there must be carried out a number of working operations or steps because between the working steps there must take place each time a drying and removal of the solvent.

c. The migration of the plasticizer cannot be prevented, so that over prolonged periods of time the coating is softened and impaired in its effectiveness.

d. The winding of foils about the propellent charge, and which foils have been imbued with the aforementioned lacquer, is cumbersome. When adhesively binding skins or hides the danger exists that such will not adequately adhere at localized regions, particularly at the seam.

e. Filled or unfilled coatings with elastomeric binders such as, for instance, polyurethanes, unsaturated polyesters or polyepoxides must be processed within the so-called "pot life", i.e. at the beginning of the hardening phase. Such coatings can only be applied by casting or pressing-on. The technique of pressing-on the coating is associated with the drawback that the working speed is small.

SUMMARY OF THE INVENTION

It is a primary object of the present invention to produce and apply an inhibitor coating possessing the following beneficial properties:

a. there can be employed casting or pouring techniques, b. slight development of smoke, c. good mechanical properties, d. good adhesion to the surface of the solid propellent charge.

DETAILED DESCRIPTION OF THE INVENTION

Now in order to implement the foregoing object, and others which will become more readily apparent as the description proceeds, the invention contemplates a new and improved inhibitor coating which is manifested by the following features:

a. the binder consists of a castable mass which possesses poor smoke developing properties, b. the filler consists of a fine grain or fine granular cooling agent possessing good packability or densification, and c. the protective- and adhesion layer consists of a completely set or cure hardened polyisocyanate forming a barrier against plasticizer migration.

The inhibitor coating which is composed in this manner effectively solves the above-stated objectives.

a. Useful For Casting Techniques

The casting technique requires mixtures possessing good flow properties. This requirement is fulfilled by means of the binder which is used, and due to the limitation of the largest possible proportion of a fine grain filler possessing high packability. By virtue of the foregoing there is of course limited the formulation possibility. However, this limitation is advantageously compensated by the advantages prevailing when employing casting techniques, to wit, high production speeds, simplicity of the method.

b. Small Development Of Smoke

Systematic experiments regarding the influence of the binder composition upon the development of smoke or fumes have shown that in particular aromatic compounds constitute the primary cause for the disturbing development of smoke or the like. All further experiments or tests therefore were directed towards producing highly-filled, but still castable insulation mixtures containing a pronounced aliphatic binder.

A. The Fillers

The fillers have the function of improving the insulating properties of the inhibitor coating. The proportion of filler is limited both by the workability of the mass employed for the insulating layer as well as also by the mechanical properties of the mixture.

It is known to use as the filler inorganic substances possessing low thermal conductivity, for instance, asbestos, mica, and quartz in powder form.

Furthermore, there are used cooling agents, that is to say, solid inorganic or organic compounds, which at elevated temperatures markedly endothermically decompose into gaseous products, and thus, cool their surroundings.

For instance, there are used compounds containing water of crystallization, such as aluminium sulfate, aluminium flouride, lithium metaborate, magnesium sulfate, sodium silicate or ammonium salts containing water of crystallization or free from water of crystallization, such as ammonium oxalate, ammonium sulfate, ammonium borate or compounds which easily decompose such as urea or melamine.

Due to the large proportion of cooling agent in the insulating layer it is possible to:

a. improve the insulating properties,
b. reduce the quantity of coarse carbonization products, which result from organic binders,
c. reduce the formation of smoke,
d. avoid clogging of the nozzles.

The cooling agents are more suitable than the inert fillers. The cooling agent should be present in a granulometric form of high packability, so that with good casting or pouring properties there is possible a high volumetric proportion of filler.

When speaking in terms of the packability of a dispersed filler there is to be understood the proportion by volume of the pure filler with complete compaction by jarring or shaking. The packability P is the quotient of the shaking density $\rho_R$ and the filler density $\rho$. This can be expressed by the following equation:

$$P = (\rho_R)/\rho$$

As the cooling agent there is particularly suitable aluminium hydroxide, $Al(OH)_3$, possessing a density equal to 2.41 g/cm$^3$ and a shaking density equal to 1.500 to 1.545 g/cm$^3$.

With such aluminium hydroxide, $Al(OH)_3$, there can be realized still good castable insulating layers with a proportion of 60 to 62 percent by weight filler.

B. The Binder

The binder is preferably composed of an isocyanate-containing polyether pre-adduct, a diamine hardener and an aliphatic plasticizer.

On the one hand, in order to be able to lower the viscosity of this pre-adduct to a degree required for the casting process, and, on the other hand, to reduce the aromatic proportion to such an extent that with slight formation of smoke there is still insured for satisfactory adhesion, there are undertaken the following measures:

a. Complete reaction of the pre-adduct with an aromatic diamine and the addition of an aliphatic plasticizer.

b. Complete reaction of the pre-adduct with a stoichiometric mixture of an aromatic diamine and a higher molecular triol.

C. The Protective- And Adhesion Layer

Between the solid propellent charge and the insulating layer there is located a protective layer which initially must be applied to the propellent charge. For this protective layer there is preferably employed a completely moisture-hardened, low-molecular triisocyanate.

This protective layer has the following function:

a. To improve the adhesion of the insulating layer at the propellent charge owing to its high concentration or urea groups formed from free isocyanate and atmospheric moisture.

b. To form a barrier against the migration of the plasticizer owing to its high degree of cross-linking due to the tri-functionality and the small molar or molecular mass.

This barrier functions in both directions in the event that both the insulating layer as well as also the propellent charge contains plasticizer. The second property is important since the plasticizer migration in the one or the other direction constitutes the cause of the impairment — which becomes increasingly more pronounced as a function of time — of the adhesion of the coating at the propellent charge until complete detachment of the coating from the propellent charge.

For this protective layer there is especially suitable the following triisocyanate:

triphenylmethane - 4,4',4'' - triisocyanate.

The lacquer-technological properties can be improved by the addition of additives, for instance 30 to 100 percent by weight of butyl acetate as the mean polar means boiler (i.e. a substance having an intermediate boiling point) to the 20%-packaged solution in methyl chloride of the aforementioned triisocyanate.

This improvement can be readily proven or ascertained by virtue of the good anchoring of the protective layer at the propellent charge and a good wetting, leading to a homogeneous film formation.

In order to transform the protective layer applied by spraying, coating or immersion into a defined condition, i.e. into a completely set or cured condition, within a useful period of time, the propellent charges provided with a protective layer are subjected for approximately 15 hours to a temperature of 60° C and a relative humidity of 70% to 90%. Consequently, the wetting process — which at room temperature and depending upon the humidity of the air lasts for 1 to 3 weeks — can be shortened.

D. Description Of Two Exemplary Embodiments Of The Invention

The invention will be now described in greater detail in conjunction with two exemplary embodiments discussed hereinafter.

EXAMPLE 1

The propellent charge is initially coated with a protective- and adhesion layer. This layer consists of a solution of:

20 parts by weight triphenylmethane- 4,4',4''-triisocyanate
80 parts by weight methylene chloride
30 parts by weight butyl acetate.

The solution must then be applied in a thin condition. After an evaporation time of 1 hour the protective layer is cured or hardened for 15 hours at 60° C in a moist atmosphere, preferably in an air circulating oven or furnace with closed air valves and with a vessel filled with water located in the oven compartment or chamber.

Thereafter there is applied an insulating layer. This consists of a mixture containing:

223.6 grams of polyether-pre-adduct possessing an isocyanate content of 4.3% as hardener.
156 grams acetyltri-n-butyl-citrate.

This mixture is degasified and dewatered in a kneader for half an hour at 70° C and a pressure of about 1 mm Hg pressure (Torr).

Thereafter there is added to the mixture the following:

780 grams of aluminium hydroxide as the filler.
Granulation size <150μ.
Packability 62%.

This mixture is then admixed or stirred for half an hour under the same conditions.

Thereafter there is added to the mixture the following:

40.4 grams molten 4,4'-methylene-bis-[2-chloroaniline] as the hardener.

The new mixture is again processed for 5 minutes in the kneader and subsequently applied to the propellent charge. For this purpose the propellent charge is placed into a casting mold, so that there is formed a 2 mm thick hollow space between the casting mold and propellent charge into which there is poured the aforementioned mixture. The propellent charge consists of a 2-basic powder i.e. a double based propellant grain or powder and possesses a diameter of 100 mm. The inner surface of the casting mold is provided with a "TEFLON" coating. After curing or hardening for 10 hours at 60° C the propellent charge provided with the coating can be removed from the casting mold.

After undergoing temperature-alternating tests of 6 cycles at −50° C to +60° C such processed propellent charge displayed no changes in the adhesion of the coating.

Stand burn-off in test chambers with nozzles of large flow constriction took place without disturbances both with tested as well as untested propellent charges at extreme temperatures of −40° C and +60° C.

Smoke measurements produced results in the order of less than 8 dB.

EXAMPLE 2

The protective layer is the same as that described with respect to the first exemplary embodiment of Example 1.

Thereafter there is applied the insulating layer. This consists of a mixture containing the following:

364.2 grams of a polyether-pre-adduct possessing an isocyanate content of 6.5%.
155.8 grams of a hardener solution consisting of 22.4 grams 4,4'-methylene-bis-[2-chloroaniline], 133.4 grams castor oil possessing an hydroxide content of 5%.

Initially the pre-adduct is degasified and dewatered in a kneader at a temperature of 70° C and a pressure of 1 mm Hg pressure (Torr), and thereafter there is added the hardener solution. After stirring or mixing for 5 minutes the mixture is filled into the mold under the same conditions as discussed above in conjunction with the first embodiment of Example 1.

Propellent charges provided with such coating gave the same results during all tests.

The inhibitor coatings can be composed of the following components, which more or less satisfactorily fulfill the stated objectives:

1. Filler-Cooling Agent

Aluminium hydroxide possessing a packability of 64%.

2. Binder

PU (A) Polyurethane - partially aliphatic - pre-adduct containing 4.3% content of isocyanate which is stoichiometrically cross linked with 4,4'-methylene-bis-[2-chloroaniline].

PU (B) Polyurethane — partially aliphatic — pre-adduct containing 6.5% content of isocyanate which is stoichiometrically cross-linked with 30 Mol % $NH_2$ from 4,4'-methylene-bis-[2-chloroanaline]
70 Mol % OH from castor oil with 5% OH.

PU (C) Polyurethane — purely aliphatic — produced in a one-shot process from polyoxypropyleneglycol and trimethylolpropane cross-linked with 4,4'-methylene-bis-(cyclohexylisocyanate) catalized with
0.5% stannous dibutyl-dilaurate
0.5% iron acetyl-acetonate
Composition of the mixture in Mol % of the reactive groups of the participating partners
Diol 70
Triol 30
NCO 100

PE Soft foam unsaturated polyester, hardened by the addition of methyl ethyl-ketone peroxide and cobalt naphthanate.

WM Acetyltri-n-butyl citrate.

DPA Diphenylamine (an aromatic substance which is readily soluble in polyurethane and added for comparative purposes)

DA 4,4'-methylene-bis-[2-chloroaniline].

Table I

Influence Of The Proportion Of Cooling Agent Upon The Development Of Smoke

| Cooling | Binder | Aromatic | (1) |
|---|---|---|---|

Table I-continued

| Ex. | Agent | PE | PU (A) | PU (B) | PU(C) | WM | DPA | Proprotion | Smoke |
|---|---|---|---|---|---|---|---|---|---|
| 4 | 60 | | 40 | | | | | | 7.0 |
| 3 | 45 | | 55 | | | | | | 10.5 |

Table II

Influence Of The Binder Composition Upon Smoke Development

| Ex. | Cooling Agent | Binder PE | PU (A) | PU (B) | PU (C) | WM | Aromatic Proportion DPA | DA | (1) Smoke |
|---|---|---|---|---|---|---|---|---|---|
| 1 | 60 | 40 | | | | | | 11 | 15 |
| 2 | 45 | | 53.5 | | | | 1.5 | 11 | 13.5 |
| 3 | 45 | | 55.0 | | | | | 11 | 10.5 |
| 4 | 60 | | 40.0 | | | | | 11 | 7.0 |
| 5 | 60 | | 28.0 | | | 12.0 | | 7.8 | 6.0 |
| 6 | 60 | | | 40 | | | | 4.3 | 6.0 |
| 7 | 60 | | | | 40 | | | 0 | 4.3 |

(1) The smoke measurement is given in dB, with average or mean weakening of the light during the burning-off.
Finally it is to be mentioned that all of the concentrations given herein, unless otherwise stated, are in percent by weight.

Obviously, many modifications and variations of the present invention are possible in the light of the above teachings. It is, therefore, to be understood that within the scope of the appended claims the invention may be practiced otherwise than as specifically described.

What is claimed is:

1. A method of producing an inhibitor coating for a solid propellent charge for protecting against undesired burning-off, the inhibitor coating containing an insulating layer composed of a binder and a filler, a protective and adhesion layer located between the insulating layer and the propellent charge, the binder having poor smoke developing properties, the filler consisting of a fine granular cooling agent possessing good packability, the protective and adhesion layer comprising a completely hardened polyisocyanate forming a barrier against plasticizer migration, said method comprising for forming the insulating layer admixing a pre-adduct to the cooling agent, and adding at least one member selected from the group consisting of an aromatic diamine, an aliphatic plasticizer and an aliphatic polyol, applying the insulating layer of the inhibitor coating to the propellent charge by casting and hardening said insulating layer at a temperature in the order of about 20° C to 80° C, and wherein prior to casting the insulating layer there is applied a protective- and adhesion layer composed of 20 parts by weight triphenylmethane- 4,4', 4''-triisocyanate, 80 parts by weight methylene chloride, and 10 to 100 parts by weight of butyl acetate.

2. The method as defined in claim 1, wherein the protective and adhesion layer, prior to casting of the insulating layer, and after an evaporation time of approximately 2 to 24 hours, is completely hardened for at least 10 hours at a temperature of about 60° C and a relative air moisture content in the order of about 70% to 90%.

3. The method as defined in claim 2, wherein the aromatic diamine is added in a dissolved state to the aliphatic plasticizer.

4. The method as defined in claim 2, wherein the aromatic diamine is added in a dissolved state to the aliphatic polyol.

5. A method of producing an inhibitor coating for a solid propellent charge for protecting against undesired charge burn-off, comprising the steps of: applying a protective and adhesion layer to the propellent charge, said protective and adhesion layer comprising a completely cross-linked polyisocyanate forming a barrier against plasticizer migration, forming an insulating layer composed of a binder and a filler, the binder having poor smoke developing properties, the filler comprising a fine grain cooling agent possessing good packability, the insulating layer being formed by initially admixing a pre-adduct with the cooling agent, and then adding an aromatic diamine and a member selected from the group consisting of an aliphatic plasticizer and an aliphatic polyol, and applying the insulating layer onto the protective and adhesion layer.

6. The method as defined in claim 5, including the step of applying the insulating layer by casting, and cross-linking the insulating layer at a temperature between about 20° C and 80° C.

7. A method of producing an inhibitor coating for a solid propellent charge for protecting against undesired charge burn-off, comprising the steps of: applying a protective and adhesion layer to the propellent charge, said protective and adhesion layer comprising a completely cross-linked polyisocyanate forming a barrier against plasticizer migration, forming an insulating layer composed of a binder and a filler, the binder having poor smoke developing properties, the filler comprising a fine grain cooling agent possessing good packability, the insulating layer being formed by admixing a pre-adduct with the cooling agent, and then adding an aromatic diamine and a member selected from the group consisting of an aliphatic plasticizer and an aliphatic polyol, applying the insulating layer onto the protective and adhesion layer by casting, and cross-linking the insulative layer at a temperature between about 20° C and 80° C, and wherein the protective and adhesion layer comprises 20 parts by weight triphenylmethane-4,4',4''-triisocyanate, 80 parts by weight methylene chloride, and 10 to 100 parts by weight of butyl acetate.

8. The method as defined in claim 7, including the steps of completely cross-linking the protective and adhesion layer, prior to casting of the insulating layer, by subjecting the protective and adhesion layer to evaporation for approximately 2 to 24 hours and to hardening for at least 10 hours at a temperature of about 60° C and a relative air moisture content in the order of about 70% to 90%.

9. The method as defined in claim 8, including the step of adding the aromatic diamine in a dissolved state to the aliphatic plasticizer.

10. The method as defined in claim 8, including the step of adding the aromatic diamine in a dissolved state to the aliphatic polyol.

* * * * *